US007677964B1

(12) United States Patent
Bucher et al.

(10) Patent No.: US 7,677,964 B1
(45) Date of Patent: Mar. 16, 2010

(54) AIR EXHAUSTING APPARATUS WITH DRAINING PASSAGE

(75) Inventors: John C. Bucher, Hillsboro Beach, FL (US); Shooupyng Wang, Ft. Lauderdale, FL (US)

(73) Assignee: Chien Luen Industries Co., Ltd. Inc., Oakland Park, FL (US)

( * ) Notice: Subject to any disclaimer, the term of this patent is extended or adjusted under 35 U.S.C. 154(b) by 609 days.

(21) Appl. No.: 11/601,123

(22) Filed: Nov. 17, 2006

(51) Int. Cl.
*F24F 13/20* (2006.01)
*B01D 46/00* (2006.01)

(52) U.S. Cl. ..... 454/356; 55/385.2

(58) Field of Classification Search ..... 454/18, 454/19, 41, 240, 242, 243, 260, 356
See application file for complete search history.

(56) References Cited

U.S. PATENT DOCUMENTS

| | | | | | |
|---|---|---|---|---|---|
| 2,926,837 | A | | 3/1960 | Coe | 230/117 |
| 2,988,381 | A | * | 6/1961 | Manna | 280/301 |
| 3,107,598 | A | * | 10/1963 | Rudy | 454/363 |
| 3,934,494 | A | | 1/1976 | Butler | 98/43 |
| 4,123,968 | A | | 11/1978 | Malott | 98/43 |
| 4,325,290 | A | * | 4/1982 | Wolfert | 454/365 |
| 4,641,571 | A | | 2/1987 | Anderson et al. | 98/72 |
| 4,648,312 | A | | 3/1987 | Schad | 98/75 |
| 5,078,047 | A | | 1/1992 | Wimberly | 454/368 |
| 5,472,466 | A | * | 12/1995 | Oler | 55/385.2 |
| 5,816,909 | A | | 10/1998 | Wunder | 454/341 |

* cited by examiner

*Primary Examiner*—Steve McAllister
*Assistant Examiner*—Helena Kosanovic
(74) *Attorney, Agent, or Firm*—Brian S. Steinberger; Law Offices of Brian S. Steinberger, P.A.

(57) ABSTRACT

An air-exhausting apparatus, device, method of assembly and use for an attic and rooftop fan, which prevents water intrusion into the housing. The fan can include a tubular base having a bottom side mounted on a roof of a room, and an upper end portion converging toward a top side of the base. A coupling sleeve unit has a first coupling end portion sleeved fixedly on the base and cooperating with the base to define an annular draining passage therebetween, and a second coupling end portion opposite to the first coupling end portion. A fan unit is mounted in the coupling sleeve unit, and is operable so as to exhaust air outwardly of the room via air holes in the second coupling end portion of the coupling sleeve unit. A cover unit includes a cover body disposed on the second coupling end portion of the coupling sleeve unit, and a supporting frame interconnecting fixedly the cover body and the coupling sleeve unit. Wear and/or sound absorbers can also be included.

9 Claims, 7 Drawing Sheets

AIR EXHAUSTING APPARATUS WITH DRAINING PASSAGE

The invention relates to air-exhausting devices such as roof and attic fans, more particularly to an air-exhausting apparatus, devices, systems and methods for preventing water intrusion and for providing drainage passages.

BACKGROUND AND PRIOR ART

Attic and rooftop fans such as those shown and described in reference to FIG. 1 have been known to become damaged from water intrusion that also damages rooms and structures underneath the locations of such fans. The water intrusion can come from condensation formed from different temperature conditions and humidity which is a long term problem especially in southern warm and humid climates such as Florida and the southern United States. In addition rain storms and hurricanes have also caused water to run into these fans which can damage the units as well as cause damage to the interior structures under the mounted fans.

FIG. 1 shows a typical and conventional air-exhausting device such as a rooftop or attic fan for exhausting air outwardly of a structure such as a house that contains a room R. The conventional air-exhausting apparatus can include a tubular base 1, a motor-mounting seat 2, a fan unit 3, and a cover 4. The tubular base 1 can have a lower open end 101 mounted on a roof 5' of the closed room, and an upper open end 102. The motor-mounting seat 2 fit with by a sleeve in the base 1, and can have a surrounding wall 202 that can be connected fixedly to the upper end 102 and that is formed with a plurality of air holes 203, and a bottom wall 204 that is connected fixedly to a bottom end of the surrounding wall 202 and that can be formed with a plurality of through holes 205.

The fan unit 3 can be mounted in the motor-mounting seat 2, and include a drive motor 301 mounted on the bottom wall 204 of the motor-mounting seat 2, and a fan impeller 302 mounted on a motor shaft 304 of the drive motor 301. A cover 4 can cover a top of the motor-mounting seat 2.

In operation, the conventional air-exhausting device can be used to exhaust air outwardly of the room R, via the through holes 205 and the air holes 203 in the motor-mounting seat 2.

As previously described, the conventional device of FIG. 1 has been known to incur water leakage problems into the room under which it is mounted.

Due to the different temperatures between the room and the outside air, Consideration and water drops has been known to form between the base 1 and the surrounding wall 202 of the motor-mounting seat 2. As a result of this significant difference between an indoor temperature and an outdoor temperature, water droplets can then leak into the room via the air exhaust device.

Additionally, water from rain storms and hurricanes, and the like, has also been known to enter into the motor-mounting seat 2 via the air holes 203 and also result in water leakage into the room via the base 1. Having water leakage can and has resulted in damage to the contents and structures inside the rooms as well as cause health risks from any resulting mold and mildew.

Still furthermore, the water leakage can damage the fan components such as the motor and cause possible short circuits, that can cause fires and other types of damage.

The lifespan of using the conventional outdoor attic and rooftop fans is severely limited since they are susceptible to damage and cannot be expected to work over extended periods of time, especially after storm and hurricane type conditions.

Solutions to try to resolve these problems are generally not practical. For example, sealing the conventional attic and rooftop fan against water leakage would not work since the fans are required to exhaust air from the structure. In addition heat from running the fan motor must also be dissipated and any sealing of the fan can result in other damage such as overheating, fire, and the like.

Thus, the need exists for solutions to the above problems with the prior art.

SUMMARY OF THE INVENTION

A primary objective of the present invention is to provide an attic and rooftop air exhausting apparatus, device method of assembly, and method for use, for preventing condensation water from entering into the fan housing and into the structure beneath the air exhausting apparatus.

A secondary objective of the present invention is to provide an attic and rooftop air exhausting apparatus, device method of assembly, and method for use, for providing exterior drainage passage of any condensation that can form inside the apparatus.

A third objective of the present invention is to provide an attic and rooftop air exhausting apparatus, device method of assembly, and method for use, for preventing outside moisture and water from storms, and the like, from entering into the fan housing and into the structure beneath air exhausting apparatus.

A fourth objective of the present invention is to provide an attic and rooftop air exhausting apparatus, device method of assembly, and method for use, for providing exterior damage passage for any outside formed moisture and water from storms, and the like, and prevent such exterior moisture and water from entering into apparatus and into the structure beneath the apparatus.

A fifth objective of the present invention is to provide an attic and rooftop air exhausting apparatus, device method of assembly, and method for use, that prevents condensation from damaging any electrical components associated with the apparatus.

A sixth objective of the present invention is to provide an attic and rooftop air exhausting apparatus, device method of assembly, and method for use, that prevents outside moisture or water from storms from damaging any electrical components associated with the apparatus.

Therefore, the object of the present invention is to provide an air-exhausting apparatus that can overcome the aforesaid problems with the prior art.

An embodiment of an air-exhausting apparatus adapted to be mounted on a roof of a room for exhausting air outwardly of the room can include a tubular base having a top side, a bottom side adapted to be mounted on the roof, a lower end portion, and an upper end portion converging toward the top side, and a coupling sleeve unit having a first coupling end portion sleeved fixedly on the base, and a second coupling end portion opposite to the first coupling end portion and formed with a plurality of air holes, the first coupling end portion of the coupling sleeve unit cooperating with the base to define an annular draining passage therebetween, wherein the draining passage has a lower passage section defined between the first coupling end portion of the coupling sleeve unit and the lower end portion of the base, and an upper passage section defined between the first coupling end portion of the coupling sleeve unit and the upper end portion of the base and having a width larger than that of the lower passage section.

The invention can include a fan unit mounted in the coupling sleeve unit and operable so as to exhaust air outwardly of the room via the air holes in the second coupling end portion of the coupling sleeve unit, and a cover unit including a cover body disposed on the second coupling end portion of the coupling sleeve unit, and a supporting frame interconnecting fixedly the cover body and the coupling sleeve unit.

Methods of using the invention with water and sound absorbers can also be used. Additionally, the invention can be used without an exhaust fan.

A novel method of preventing condensation water intrusion and exterior rain/storm water intrusion into a roof top exhaust is also described.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

Figure 1:
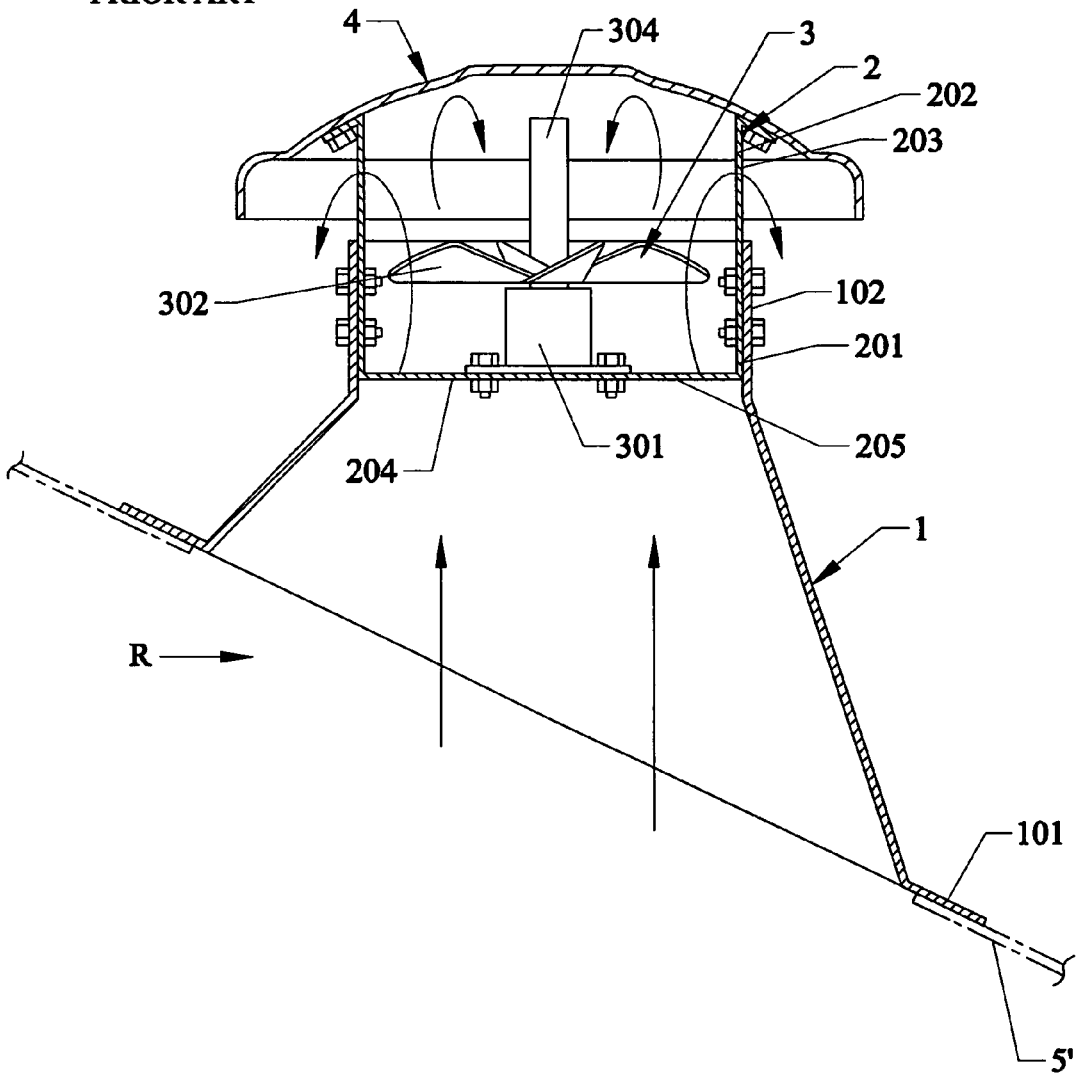
Fig. 1 PRIOR ART
FIG. 1 shows a cross-sectional view of a prior art conventional air-exhausting apparatus.
Figure 2:
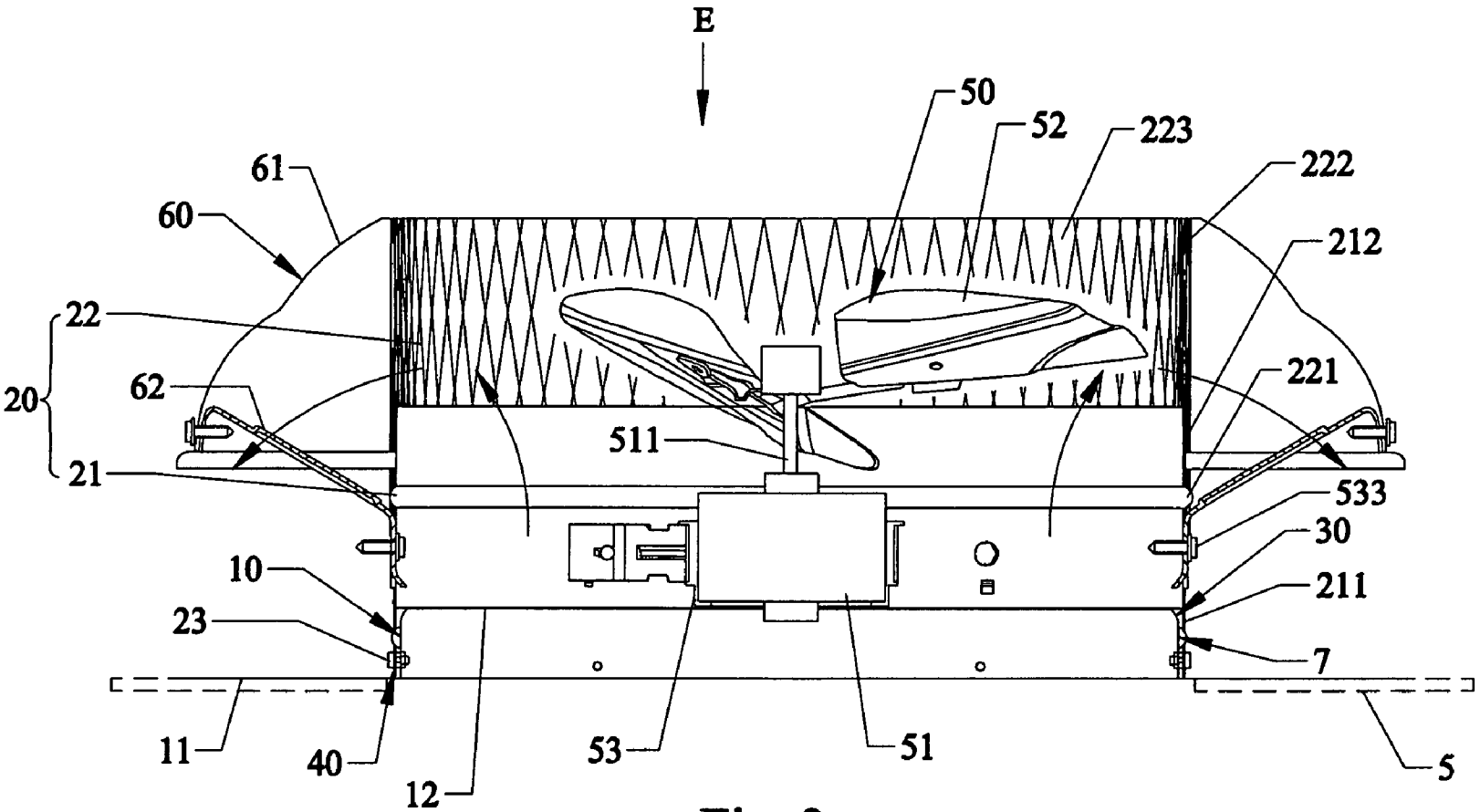
FIG. 2 is a cross-sectional view of a preferred embodiment of an air-exhausting apparatus according to the present invention.
Figure 3A:
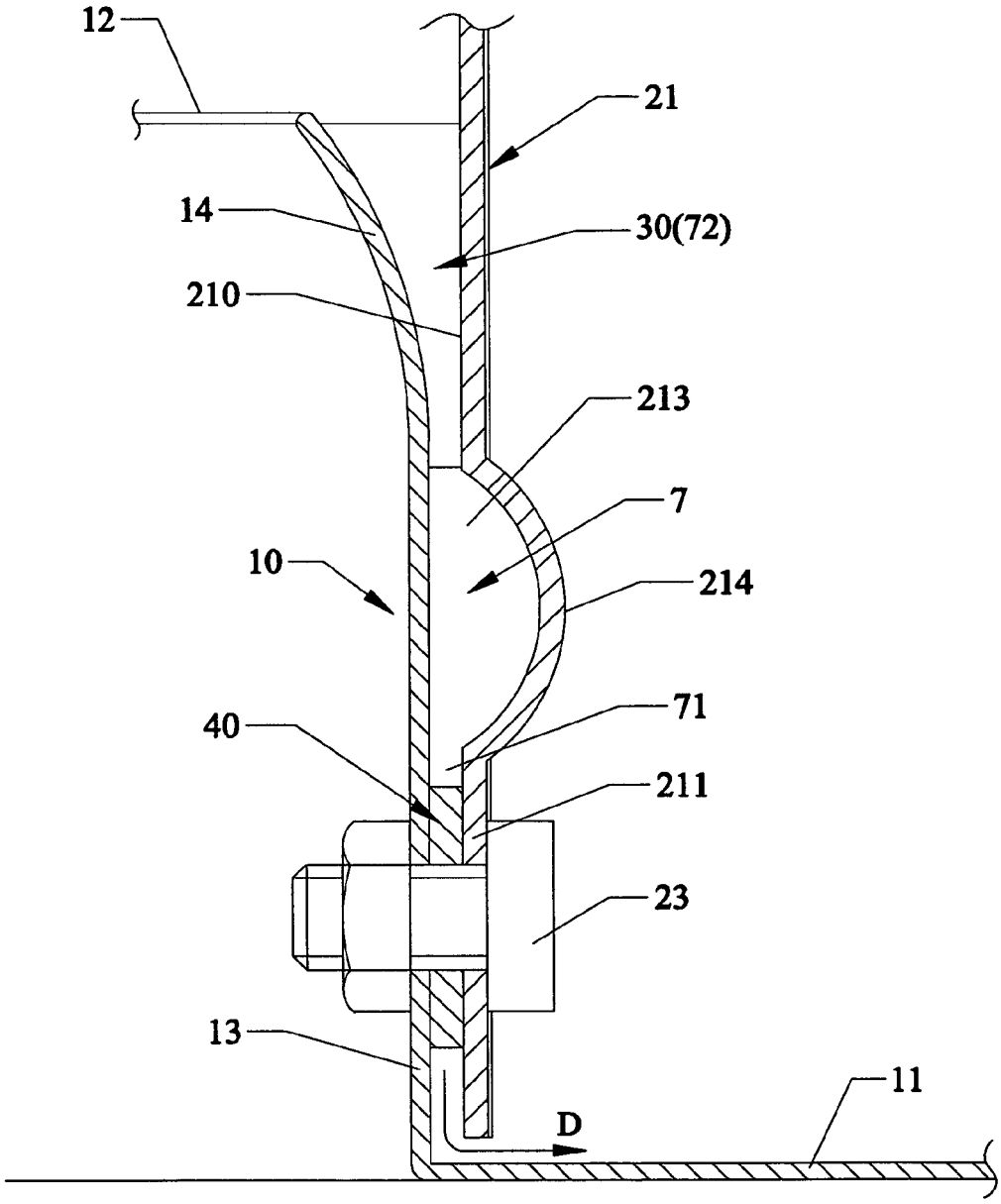
FIG. 3A is an enlarged portion of a lower cross-sectional view of the preferred embodiment shown in FIG. 2 with fasteners.
Figure 3B:
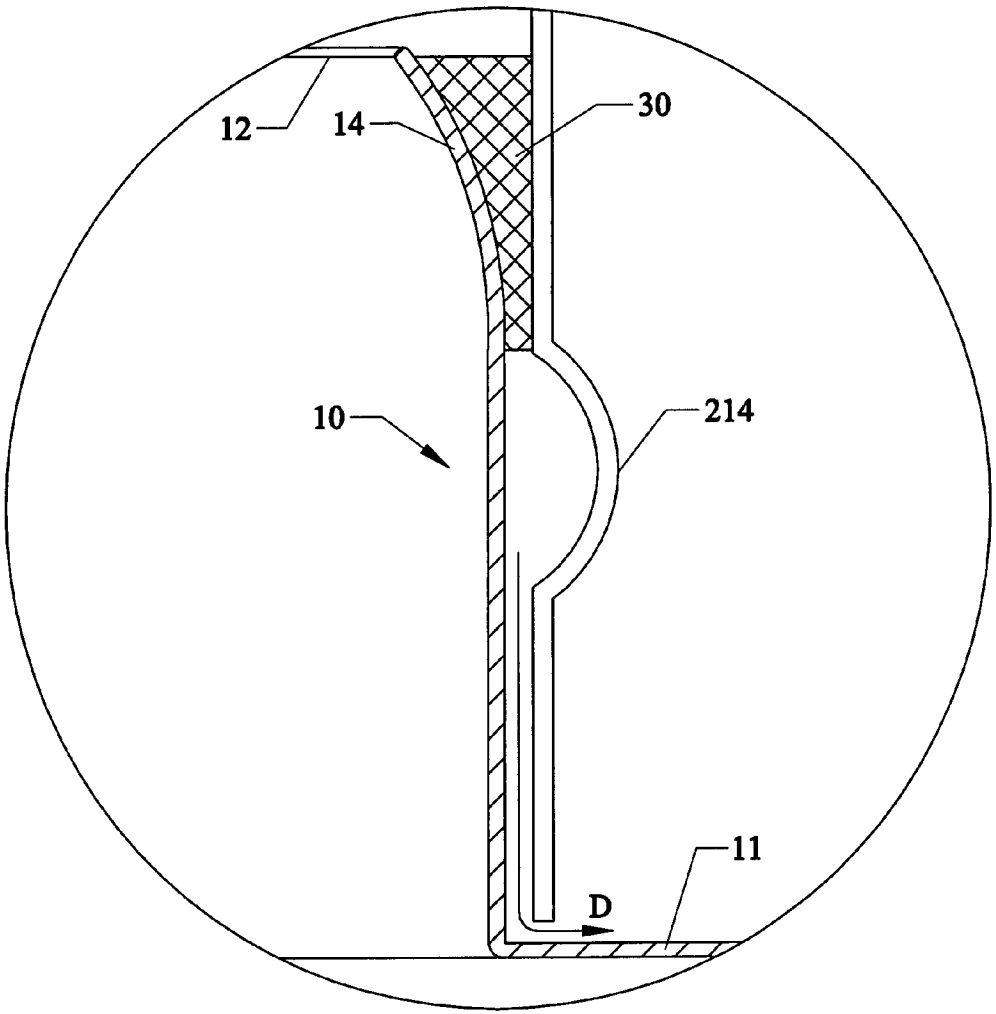
FIG. 3B is another enlarged portion of the lower cross-sectional view of the preferred embodiment shown in FIG. 2 between the fasteners.
Figure 4:
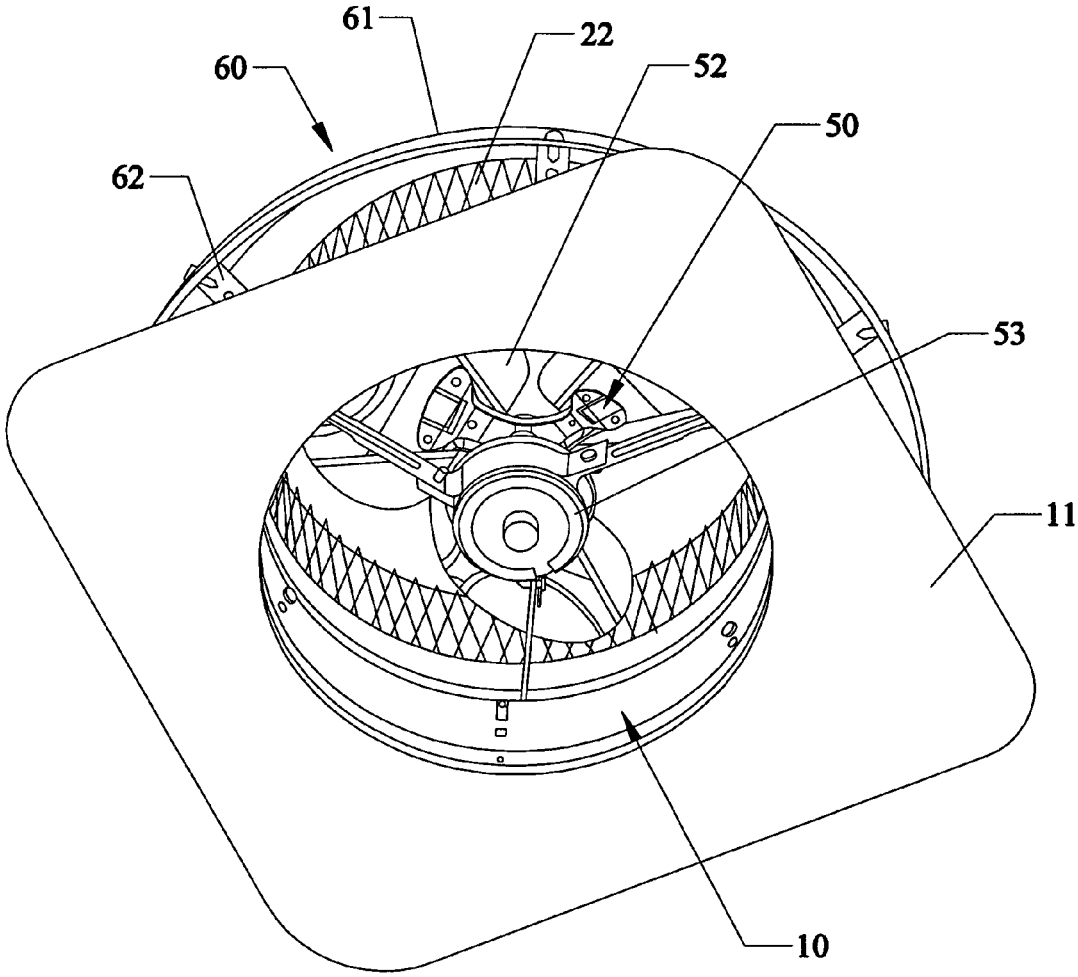
FIG. 4 is a bottom perspective view showing the preferred embodiment of the preceding figures.
Figure 5:
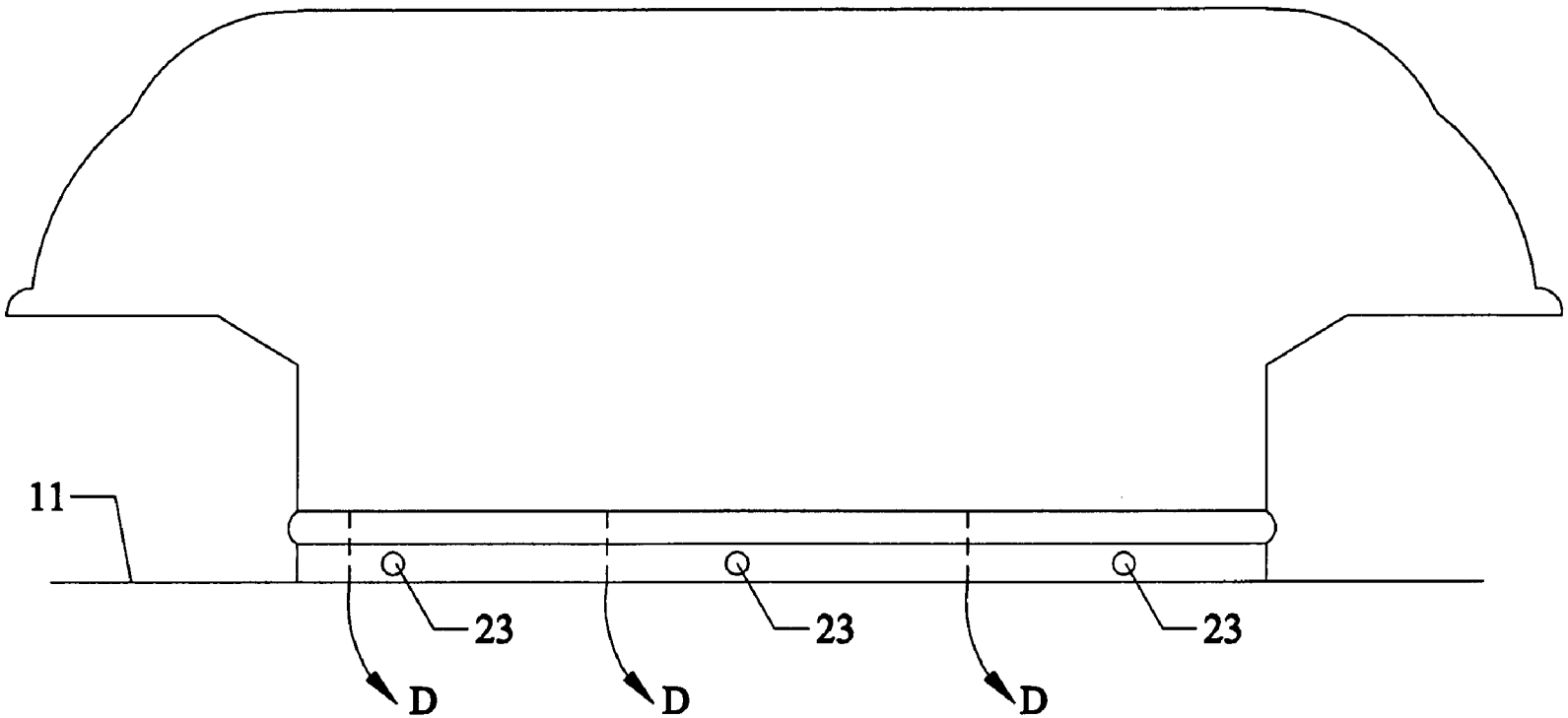
FIG. 5 is an outer side view of the preferred embodiment of the invention showing drainage areas between base fasteners.
Figure 6:
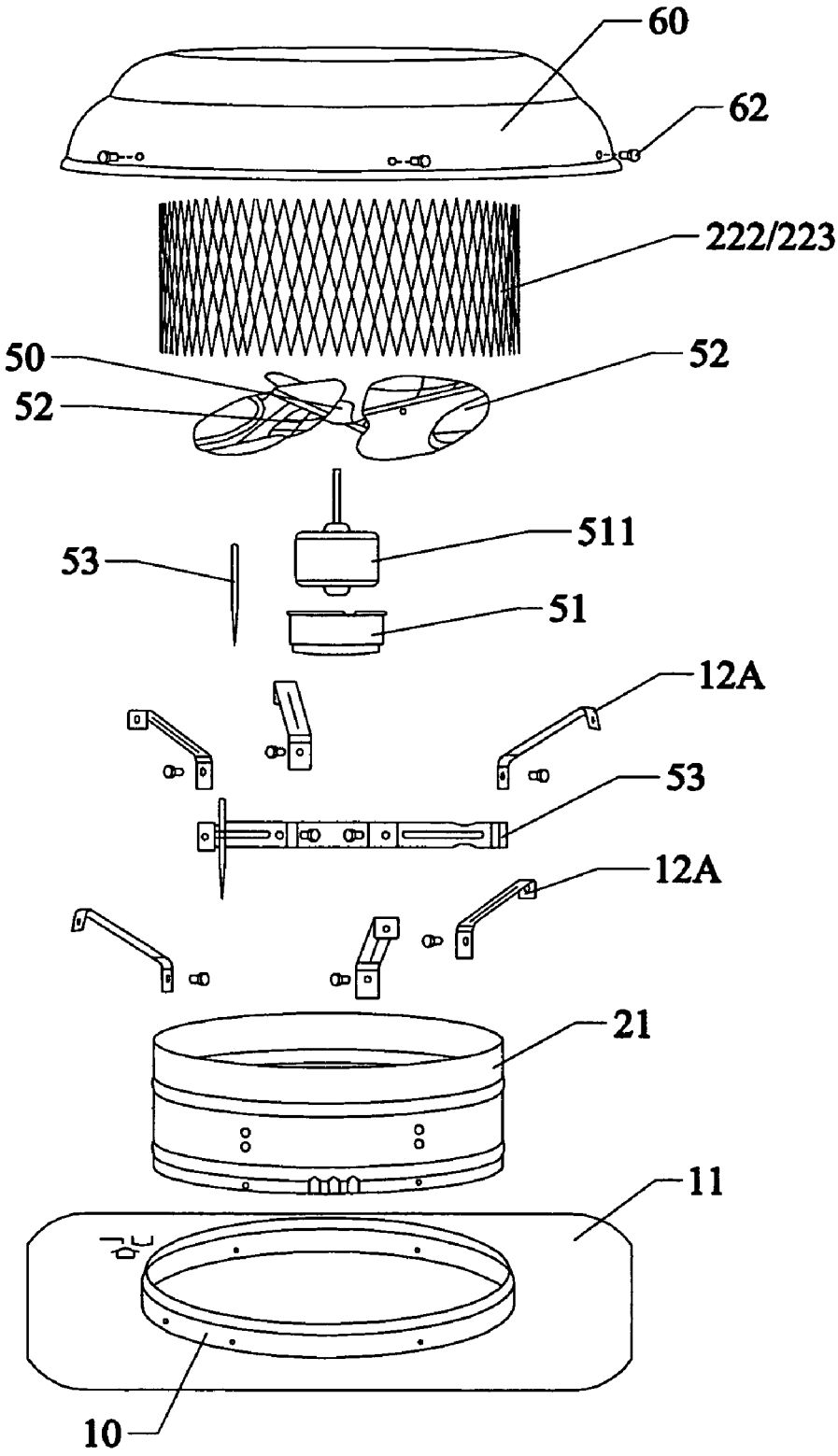
FIG. 6 is an exploded view of the novel invention.

A list of the components will now be described:

R room
E Invention embodiment
1 tubular base
2 motor mounting seat
3 fan unit
4 cover
5' roof
7 annular draining passage
10 tubular base (invention)
11 outer extending bottom side of tubular base
12 spider shaped top side (in middle of tubular base 10)
12A arms
12B central support
13 lower end portion
14 upper inwardly bending end portion
20 coupling sleeve unit
21 first sleeve
22 second netted sleeve
23 screw fasteners
30 annular sponge member
40 resilient members
50 fan unit
51 driver motor
52 fan impeller
53 motor mounting frame
60 cover unit
61 cover body
62 supporting frame
71 lower passage section of draining passage 7
72 upper passage section of draining passage 7
101 lower open end
102 upper open end
202 surrounding wall
203 plurality of air holes
204 bottom wall
205 plurality of holes
210 annular inner surface
211 lower end portion
212 upper end portion
213 annular water storage groove
222 upper end portion
223 meshes (plurality of air holes)
301 drive motor
302 fan impeller
304 motor shaft
511 motor shaft
533 screw fasteners FIG. 2 is a cross-sectional view of a preferred embodiment of an air-exhausting apparatus E according to the present invention. FIG. 3A is an enlarged portion of lower cross-sectional view of the preferred embodiment E shown in FIG. 2 with the fasteners 23. FIG. 3B is another enlarged portion of the lower cross-sectional view of the preferred embodiment shown in FIG. 2 between the fasteners 23. FIG. 4 is a bottom perspective view showing the preferred embodiment of the preceding figures. FIG. 5 is an outer side view of a preferred embodiment of the invention showing drainage areas between base fasteners 23. FIG. 6 is an exploded view of the components of the novel invention.

Referring to FIGS. 2 to 6, the preferred embodiment of an air-exhausting apparatus according to the present invention is shown to be adapted to be mounted on a roof 5 of a room (not shown) for exhausting air outwardly of the room. The air-exhausting apparatus includes a tubular base 10, a coupling sleeve unit 20, a fan unit 50, and a cover unit 60.

The tubular base 10 can have a top side 12 (across the middle of the tubular base 10) having a spider type shape on which the drive motor 51 can sit, an outer extending bottom side 11 adapted to be mounted on the roof 5, a lower end portion 13, and an upper inwardly bending end portion 14 converging toward the top side 12. Here, the bottom side 11 of the tubular base 10 can be in the form of a plate.

The coupling sleeve unit 20 can have a first coupling end portion, and a second coupling end portion (upper end portion 222) opposite to the first coupling end portion and formed with a plurality of air holes 223. In this embodiment, the coupling sleeve unit 20 includes a first sleeve 21 and a netted second sleeve 22.

The first sleeve 21 has a lower end portion 211 that serves as the first coupling end portion of the coupling sleeve unit 20, that is sleeve fixedly on the base 10, and that is connected to the lower end portion 13 of the base 10 by a plurality of screw fasteners 23, and an upper end portion 212. As shown in FIG. 3, the lower end portion 211 of the first sleeve 21 cooperates with the base 10 to define an annular draining passage 7, wherein the draining passage 7 has a lower passage section 71 defined between the lower end portion 211 of the first sleeve 21 and the lower end portion 13 of the base 10, and an upper passage section 72 defined between the lower end portion 211 of the first sleeve 21 and the upper end portion 14 of the base 10.

Upper passage 30 can be funnel shaped with a width larger than that of the lower passage section 71. The first sleeve 21 has an annular inner surface 210 formed with an annular water-storage groove 213 in fluid communication with the draining passage 7 and disposed between the lower and upper passage sections 71, 72 of the draining passage 7.

The second sleeve 22 can have a lower end portion 221 sleeve fixedly on the upper end portion 212 of the first sleeve 21, an upper end portion 222 that serves as the second coupling end portion of the coupling sleeve unit 20 and that is opposite to the first coupling end portion, and a plurality of meshes constituting the air holes 223.

A continuous annular sponge type member 30 can be sleeved on the upper end portion 14 of the base 10, and can be disposed in the upper passage section 72 of the draining passage 7, as best shown in FIG. 3. In other embodiments, the sponge member 30 can include a plurality of sponge blocks disposed in the upper passage section 72 of the draining passage 7 and spaced apart from each other. The sponge member(s) 30 can be but is not limited to open cell foam, plastic, resin, and the like, that can absorb and hold moisture and water therein.

A plurality of resilient buffering members 40 are disposed in the lower passage section 71 of the draining passage 7, and are clamped between the lower end portion 211 of the first sleeve 21 and the lower end portion 13 of the base 10, as best shown in FIG. 3. In this embodiment, the resilient buffering members 40, such as resilient washers, can be sleeved respectively on the screw fasteners 23. The resilient members 40 can include but are not limited to elastomer, rubber, plastic, combinations, thereof, and the like. The resilient members 40 can further dampen and absorb sound, noise, from outside the invention or that comes from the fan motor and blades 50.

The fan unit 50 can be mounted in the coupling sleeve unit 20, and can be operable so as to exhaust air outwardly of the room via the mesh air holes 223 in the second sleeve 22 of the coupling sleeve unit 20. In this embodiment, the fan unit 50 includes a motor-mounting frame 53 and spider structure 12 (with arms 12A) connected fixedly to the first sleeve 21 of the coupling sleeve unit 20 by a plurality of screw fasteners 533, a drive motor 51 mounted on the motor-mounting frame 53, and a fan impeller 52 mounted on a motor shaft 511 of the drive motor 51, as shown in FIG. 2.

A cover unit 60 can include a cover body 61 disposed on the upper end portion 222 of the second sleeve 22 of the coupling sleeve unit 20. Cover unit 60 can also include a supporting frame 62 interconnecting fixedly the cover body 61 and the first sleeve 21 of the coupling sleeve unit 20. The supporting frame 62 can be plastic mesh material that is angularly sloped.

The novel operation of the invention will now described in reference in FIGS. 2, 3A, 3B, 4, 5 and 6. As previously described water drops can form inside of these types of attic exhaust apparatus from condensation as a result of significant indoor and outdoor temperature differential. Due to the presence of the novel draining passage 7 in the novel configuration, such water droplets can form inside on the inner surface 210 of the first sleeve 21 of the coupling sleeve unit 20 and can be guided to flow downwardly by gravity into the draining passage 7 in the direction of arrows D between screw fasteners 23 and onto outer plate 11 and safely onto roof R away from the air exhaust apparatus. The novel configuration of the invention allows for condensation to flow safely outwardly away from the room R.

Furthermore, the sponge member(s) 30 can absorb liquid of water drops from the condensation, and can prevent the liquid stored in the water-storage groove 213 in the first sleeve 21 from flowing upwardly into the room.

In case of outside formed water from storms, rain, and the like, the invention can further prevent such water from entering into the apparatus and into the room underneath the air exhaust apparatus. For example, in the case of heavy rain on the roof, the water-storage groove 213 in the first sleeve 21 can function as a buffer level of any liquid that begins to rise. As such, the air-exhausting apparatus of the present invention can efficiently avoid the water leakage problem encountered in the prior art.

The sponge member(s) 30 can be optimized to expand when in contact with water and further prevent water infiltration into the air exhaust apparatus.

Over time (such as during dry conditions, daytime hours with exposed sun, etc.) the sponge member(s) 30 can safely dry out and even leak out such absorbed water safely between the screw fasteners and onto the outer plate 11 and onto the outer roof R.

In addition, the presence of the sponge member(s) 30 and the resilient buffering members 40, can also absorb, dampen and minimize any noise and unwanted sounds such as but not limited to those unwanted sounds due to vibration during use of the fan unit 50.

Although the invention is shown to be positioned on flat roof surfaces, the invention can be used on different surfaces such as sloped roofs, on the apex of a roof, and the like.

A prototype of the invention was tested in April 2006 under wind driven rain testing in accordance with Florida Building Code Test protocols for High Velocity Hurricane Zone, Protocol TAS 100A. All tests were performed in accordance with TAS 100(A)-95 Test Procedure for Wind and Wind Driven Rain Resistance and/or increased Windspeed Resistance of Soft Ventilation Strip and Continuous or Intermittent Ventilation System Installed at the Ridge area on a roof.

The tested specimen include a 1000 cfm solar powered roof mounted attic ventilator having the attributes of the invention referenced above, where the invention was tested as a roof vent. The mounting base size was approximately 24 inches wide by approximately 24 inches long. The invention tested included an approximately 15 inch diameter and approximately 5½ inch tall cylinder centered on a base plate. The 24 inch diameter by 5 inch tall dome was attached to the cylinder with six equally spaced support braces. Each support brace was connected at the dome and at the cylinder with 2¼-20×½ inch bolts. The cylinder was fastened to the base plate with pop-rivets, every approximately 8 inches from one another.

The roof deck used was an approximately 8 foot wide roof deck on a 3:12 slope. The roof deck consisted of Spruce-Pine-Fir #2 nominal 2×6 lumbar sheathed with 15/32' thick plywood. The rafters were spaced approximately 24 inches on center. The plywood was nailed to the rafters using 8d common nails spaced approximately 6 inches on center around the plywood perimeter and approximately 12 inches on center at intermediate supports. A single layer of 30 lb roof paper was applied over the top of the plywood sheathing. The paper was then covered with three tab asphalt shingles. The shingles were then sealed with silicone.

Installation and anchorage had the novel invention secured to the roof deck with eight (8) approximately 1 inch long by ⅜ inch diameter head galvanized steel roofing nails with a shank diameter of approximately ⅛ inch. A single nail was located at each bottom corner and one approximately 3 inch on either side (three per corner). A nail was located on each top center.

For the wind and rain supply, an engine powered vane axial fan (AT1-Y003345) with calibrated water supply and water distribution systems was used for the testing. Table 1 lists the test procedure with the wind speed intervals.

TABLE 1

| Test Conditions | | | |
|---|---|---|---|
| Interval No. | Wind Speed(mph) | Time(min.) | Water-Spray |
| 1 | 35 | 15 | On |
| 2 | 0 | 5 | Off |
| 3 | 70 | 15 | On |
| 4 | 0 | 5 | Off |
| 5 | 90 | 15 | On |
| 6 | 0 | 5 | Off |
| 7 | 110 | 5 | On |
| 8 | 0 | 5 | Off |

The test results were recorded under the Protocol TAS 100(A)-95 Wind Driven Rain, the results of which are shown in Table 2.

TABLE 2

| Test Results | |
|---|---|
| Wind Speed(mph) | Results |
| 35 mph | No Leakage |
| 70 mph | 2.78 oz. |
| 90 mph | 7.40 oz. |
| 110 mph | 2.47 oz. |
| | 12.65 oz. |

The water applied during the tests was (50 min)×(5.49 gal/ft2/hr)×(1 hr/60 min)×(48 ft2)=219.6 gal=28,109 oz. The amount of water that passed was approximately 12.65 oz. The percentage of water that passed into the apparatus was 12.65/28,109×100%=0.045%<0.050%. The results were the prototype passed the testing. To show compliance with the TAS 100(A), two prototypes were installed and tested together. Water passed was the sum of water passed for two prototypes.

Although the invention is described for use with air exhaust apparatus having fans, the invention can be used with exterior vents that do not require fans.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. An air-exhausting apparatus adapted to be mounted on a roof of a structure for exhausting air outwardly of the structure, the air-exhausting apparatus comprising:

a tubular base having a top side, a bottom side adapted to be mounted on the structure, a lower end portion being cylindrical, the top side having an upper perimeter end portion converging inwardly, the lower end portion having an opening thereto with a diameter being substantially larger than a diameter in an opening through the upper end portion, and a spider platform covering the upper opening through the upper end portion;

a fan mounted on top of the spider platform covering the upper opening of the tubular base;

a coupling sleeve unit having a generally cylindrical shape with a first coupling end portion forming a first generally cylindrical sleeve that is wrapped outside the base, the sleeve having a lower end with a lower diameter, a middle portion with a middle diameter, and an upper end with an upper diameter, wherein the lower diameter of the lower end of the sleeve is substantially identical to the upper diameter of the upper end of the sleeve, and the middle diameter of the middle portion being larger than both the lower and the upper diameters, and an annular space between the sleeve and the base forming a draining passage therebetween completely about the base, with an enlarged annular space between the middle portion and the base, and the middle portion of the first sleeve being substantially below the upper opening of said base, and a coupling sleeve unit having a second coupling end portion opposite to said first coupling end portion, the second coupling end portion forming a second cylindrical sleeve that extends above and about the base, the second cylindrical sleeve having a continuous diameter substantially identical to the lower and the upper diameters of the first sleeve, the second cylindrical sleeve formed with a plurality of air holes, said first coupling end portion of said coupling sleeve unit cooperating with said base to define the annular draining passage therebetween, wherein said draining passage has a lower passage section being a cylindrical shaped passage defined between said lower portion of the first sleeve and said lower end portion of said base so as to drain water onto the roof structure, and a middle passage section defined between the middle portion of the first sleeve and the base having an outer concave curved ring shaped passage, and an upper passage section defined between said upper portion of the first sleeve and said upper end portion of said base and having a funnel shaped passage with a top portion having a substantially wider passage thereto than a bottom portion;

the mounted fan in said coupling sleeve unit operable so as to exhaust air outwardly of the structure via said air holes in said second coupling end portion of said coupling sleeve unit, the mounted fan being positioned above the funnel shaped passage and the concave curved ring shaped passage and the cylindrical shaped passage; and a cover unit including a cover body disposed on the second cylindrical sleeve of said second coupling end portion of said coupling sleeve unit, and a supporting frame interconnecting fixedly said cover body and said coupling sleeve unit.

2. The air-exhausting apparatus as claimed in claim 1, further comprising a sponge member disposed solely in the funnel shaped passage of said upper passage section of said draining passage, the sponge member for absorbing water passing through the funnel shaped passage.

3. The air-exhausting apparatus as claimed in claim 1, further comprising a plurality of resilient buffering members solely disposed in the cylindrical shaped passage in said lower passage section of said draining passage and clamped between said first coupling end portion of said coupling sleeve unit and said lower end portion of said base, the resilient buffering members for absorbing and dampening unwanted sound and noise from the apparatus.

4. The air-exhausting apparatus as claimed in claim 1, wherein said openings in the second sleeve includes:

a plurality of meshes constituting said air holes.

5. A method for preventing water intrusion into a roof mounted air exhaust apparatus comprising the steps of:

mounting a covered air exhaust apparatus by a cylindrical enclosed base on a roof surface;

attaching a second enclosed base being generally cylindrical about the enclosed base; and forming a peripheral space between the second enclosed base and the mounting base, the peripheral space forming an annular passage completely about the base;

forming a funnel shaped annular passage in an upper portion of the annular passage from trapping water between the second base and the enclosed base to pass therethrough;

passing the water from the funnel shaped passage through a ring shaped concave curved annular passage; and passing the water from the ring shaped concave curved passage through a cylindrical annular passage, wherein the water is able to drain between the mounting base and the cylindrical annular passage of the second enclosed base onto the roof surface; and absorbing the water in the funnel shaped annular passage between the mounting base and the second enclosed base by an absorbing member solely located in the funnel shaped annular space.

6. The method of claim 5, further comprising the step of:

dampening unwanted sound and noise in the cylindrical annular passage between the mounting base and the second enclosed base, with dampening members solely located in the cylindrical annular passage.

7. The method of claim 6, further comprising the step of:

clamping the second enclosed base to the mounting body solely through the dampening members with bolts therethrough.

8. An air-exhausting apparatus adapted to be mounted on a roof of a structure for exhausting air outwardly of the structure, the air-exhausting apparatus comprising:

a tubular base having a top side, a bottom side adapted to be mounted on the structure, a lower end portion being cylindrical, the top side having an upper perimeter end portion converging inwardly, the lower end portion having an opening thereto with a diameter being substantially larger than a diameter in an opening through the upper end portion, and a spider platform covering the upper opening through the upper end portion;

a fan mounted on top of the spider platform covering the upper opening of the tubular base;

a coupling sleeve unit having a generally cylindrical shape with a first coupling end portion forming a first generally cylindrical sleeve that is wrapped outside the base, the sleeve having a lower end with a lower diameter, a middle portion with a middle diameter, and an upper end with an upper diameter, wherein the lower diameter of the lower end of the sleeve is substantially identical to the upper diameter of the upper end of the sleeve, and the middle diameter of the middle portion being larger than both the lower and the upper diameters, and an annular space between the sleeve and the base forming a draining passage therebetween completely about the base, with an enlarged annular space between the sleeve and the base, and the middle portion of the sleeve being substantially below the upper opening of the tubular said base, and a coupling sleeve unit having a second coupling end portion opposite to said first coupling end portion the second coupling end portion forming a second cylindrical sleeve that extends above and about the base, the second cylindrical sleeve having a continuous diameter substantially identical to the lower and the upper diameters of the first sleeve, the second cylindrical sleeve formed with a plurality of air holes, said first coupling end portion of said coupling sleeve unit cooperating with said base to define the annular draining passage therebetween, wherein said draining passage has a lower passage section being a cylindrical shaped passage defined between said lower portion of the first sleeve and said lower end portion of said base so as to drain water onto the roof structure, and a middle passage section defined between the middle portion of the first sleeve and the base having an outer concave curved ring shaped passage, and an upper passage section defined between said upper portion of the first sleeve and said upper end portion of said base and having a funnel shaped passage with a top portion having a substantially wider passage thereto than a bottom portion;

the mounted fan in said coupling sleeve unit operable so as to exhaust air outwardly of the structure via said air holes in said second coupling end portion of said coupling sleeve unit, the mounted fan being positioned above the funnel shaped passage and the concave curved ring shaped passage and the cylindrical shaped passage; p1 a cover unit including a cover body disposed on the second cylindrical sleeve of said second coupling end portion of said coupling sleeve unit, and a supporting frame interconnecting fixedly said cover body and said coupling sleeve unit;

a water absorbing member disposed solely in the funnel shaped passage of said upper passage section of said draining passage, the water absorbing member for absorbing water passing through the funnel shaped passage; and a plurality of resilient buffering members solely disposed on the cylindrical shaped passage in said lower passage section of said draining passage and clamped between said first coupling end portion of said coupling sleeve unit and said lower end portion of said base, the resilient buffering members for absorbing and dampening unwanted sound and noise from the apparatus.

9. The apparatus of claim 8, further comprising:

bolt fasteners for clamping the second enclosed base to the mounting base solely through the dampening members.

* * * * *